US011685176B2

(12) United States Patent
Sawada

(10) Patent No.: US 11,685,176 B2
(45) Date of Patent: Jun. 27, 2023

(54) RECORDING APPARATUS

(71) Applicant: SEIKO EPSON CORPORATION, Tokyo (JP)

(72) Inventor: Keishi Sawada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/648,308

(22) Filed: Jan. 19, 2022

(65) Prior Publication Data

US 2022/0234372 A1 Jul. 28, 2022

(30) Foreign Application Priority Data

Jan. 22, 2021 (JP) ..... JP2021-008553

(51) Int. Cl.
*B41J 11/70* (2006.01)
*B41J 11/00* (2006.01)
*B41J 11/42* (2006.01)

(52) U.S. Cl.
CPC ..... *B41J 11/706* (2013.01); *B41J 11/0045* (2013.01); *B41J 11/42* (2013.01)

(58) Field of Classification Search
CPC ..... B41J 11/706; B41J 11/045; B41J 11/42; B41J 11/70; B41J 15/042; B26D 2007/0018; B65H 31/22; B65H 2801/12; B65H 2801/06
USPC ..... 400/621
See application file for complete search history.

(56) References Cited

U.S. PATENT DOCUMENTS

2011/0024966 A1* 2/2011 Fujii ..... G03G 15/6552 271/3.14
2014/0178117 A1* 6/2014 Takei ..... B41J 11/70 400/621
2018/0354739 A1* 12/2018 Shimmachi ..... B65H 31/20

FOREIGN PATENT DOCUMENTS

JP 2015-063382 A 4/2015
WO WO-2019123637 A1 * 6/2019 ..... B41J 11/70

* cited by examiner

*Primary Examiner* — Leslie J Evanisko
(74) *Attorney, Agent, or Firm* — Workman Nydegger

(57) ABSTRACT

A recording apparatus includes a housing that houses a recording unit that performs recording on the medium transported by a transport unit, a cutting unit that is disposed downstream of the recording unit and that cuts the medium, a discharge unit that is disposed downstream of the cutting unit and that discharges the medium, a storage unit that is disposed below the cutting unit and that is configured to store cutting waste of the medium, and a receiving unit that is disposed downstream of the discharge unit and that has a receiving surface configured to receive the medium discharged from the discharge unit, wherein the storage unit and the receiving unit are integrated, and the integrated storage unit and receiving unit are configured to be detachable from the housing.

7 Claims, 12 Drawing Sheets

RECORDING APPARATUS

The present application is based on, and claims priority from JP Application Serial Number 2021-008553, filed Jan. 22, 2021, the disclosure of which is hereby incorporated by reference herein in its entirety.

BACKGROUND

1. Technical Field

The present disclosure relates to a recording apparatus.

2. Related Art

In the related art, as shown in JP-A-2015-63382, a recording apparatus is known that includes a recording unit that performs recording on a transported medium, a cutting unit that cuts the medium, a storage container that stores cutting waste, and a receiving unit that is attached to the storage container and receives the cut medium.

However, in the above-described recording apparatus, the storage container and the receiving unit are formed separately. Therefore, for example, when the recording apparatus is used with the receiving unit detached from the storage container, a place is necessary for placing the detached receiving unit. Further, there is a problem that the removed receiving unit is easily lost.

SUMMARY

A recording apparatus includes a housing that houses a transport unit that transports a medium in a transport direction, a recording unit that performs recording on the medium transported by the transport unit, a cutting unit that is disposed downstream of the recording unit in the transport direction and that cuts the medium, and a discharge unit that is disposed downstream of the cutting unit in the transport direction and that discharges the cut medium; a storage unit that is disposed below the cutting unit and that is configured to store cutting waste of the medium; and a receiving unit that is disposed downstream of the discharge unit in the transport direction and that has a receiving surface configured to receive the medium discharged from the discharge unit; wherein the storage unit and the receiving unit are integrated, and the storage and the receiving unit which are integrated are configured to be detachable from the housing.

DESCRIPTION OF EMBODIMENTS

1. First Embodiment

First, configuration of a recording apparatus 11 will be described. The recording apparatus 11 is, for example, a printer that performs recording (printing) by ejecting ink, which is an example of a liquid, onto a medium S, such as paper.

In each figure, the direction along the X-axis is the lateral width direction of the recording apparatus 11, the direction along the Y-axis is the depth direction of the recording apparatus 11, and the direction along the Z-axis is the height direction of the recording apparatus 11. In the present embodiment, the +Y-direction side of the recording apparatus 11 is the front-surface side, and the −Y-direction side is the back-surface side.

Figure 1:
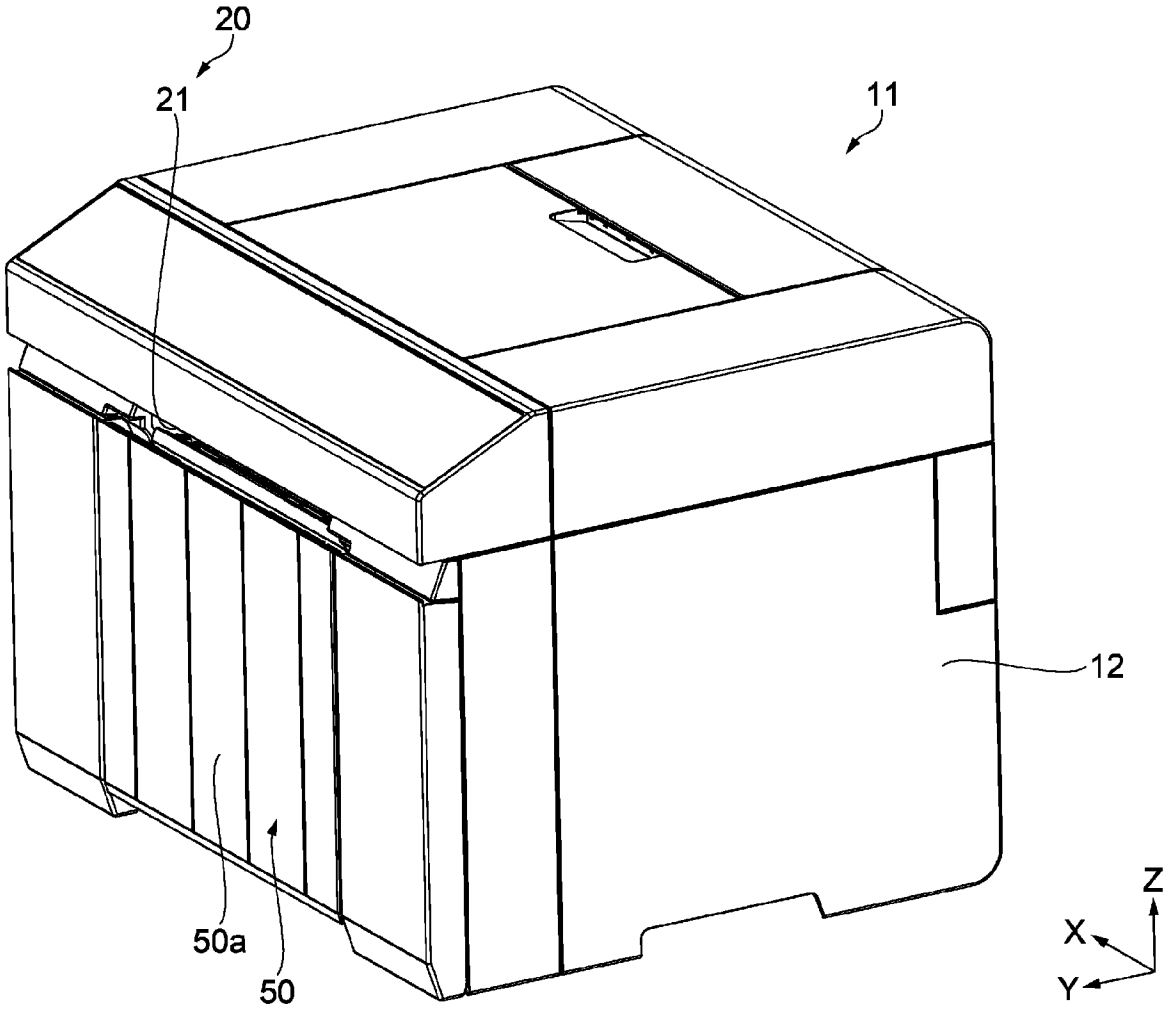
FIG. 1 is a perspective view illustrating configuration of a recording apparatus according to a first embodiment.
Figure 2:
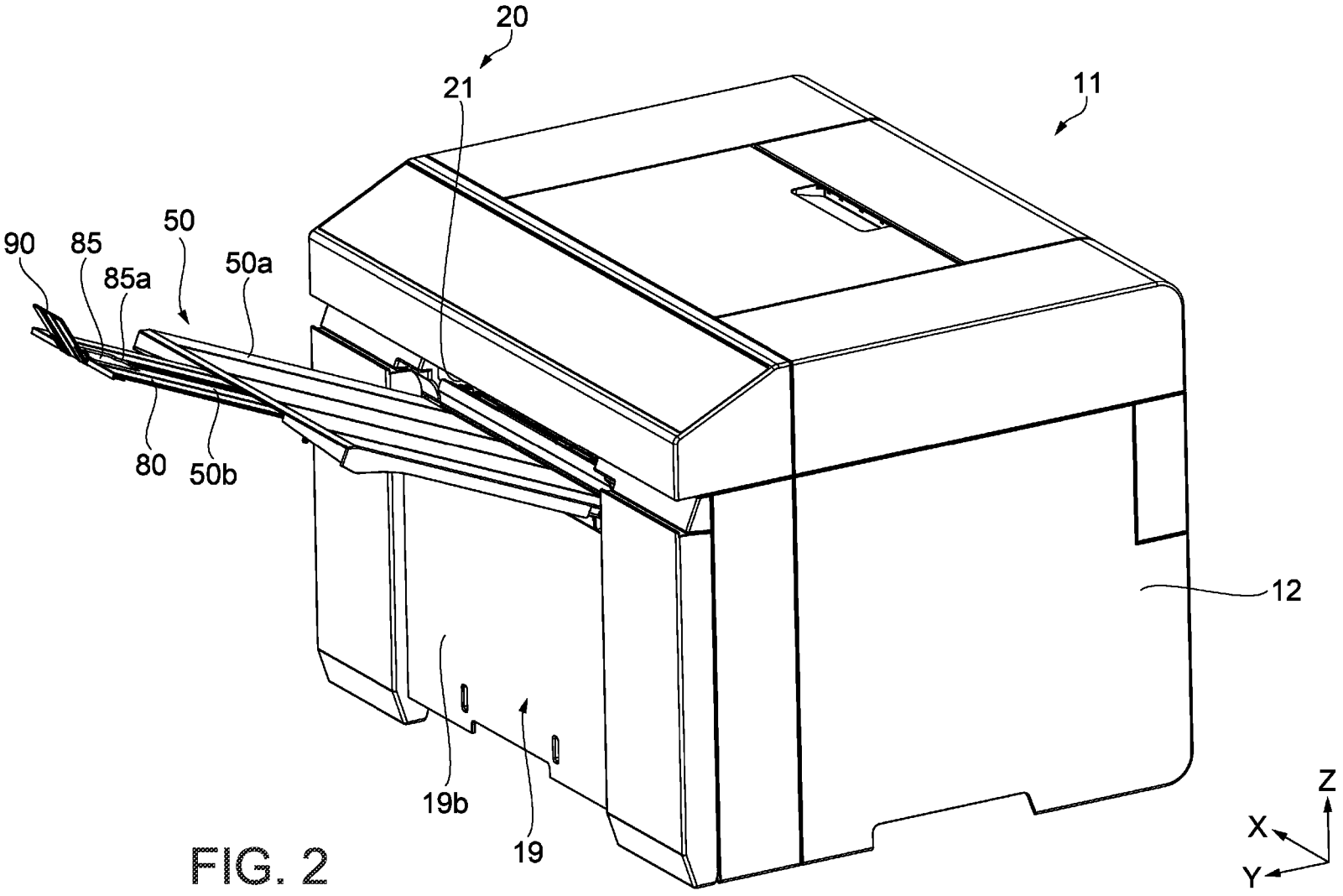
FIG. 2 is a perspective view illustrating configuration of the recording apparatus according to the first embodiment.

As shown in FIGS. 1 and 2, the recording apparatus 11 includes a housing 12. The housing 12 has a box-shaped exterior. At the front-surface side of the recording apparatus 11 are provided a receiving unit 50 for receiving the recorded medium S and a storage unit 19 that stores cutting waste of the medium S.

FIG. 1 shows a storage state in which the receiving unit 50 retreats to the housing 12 side, and FIG. 2 shows a receiving state in which the receiving unit 50 advances toward the +Y-direction from the housing 12.

As shown in FIG. 1, when the receiving unit 50 is in the storage state, the receiving unit 50 covers the storage unit and constitutes a part of the exterior of the recording apparatus 11.

Figure 3:
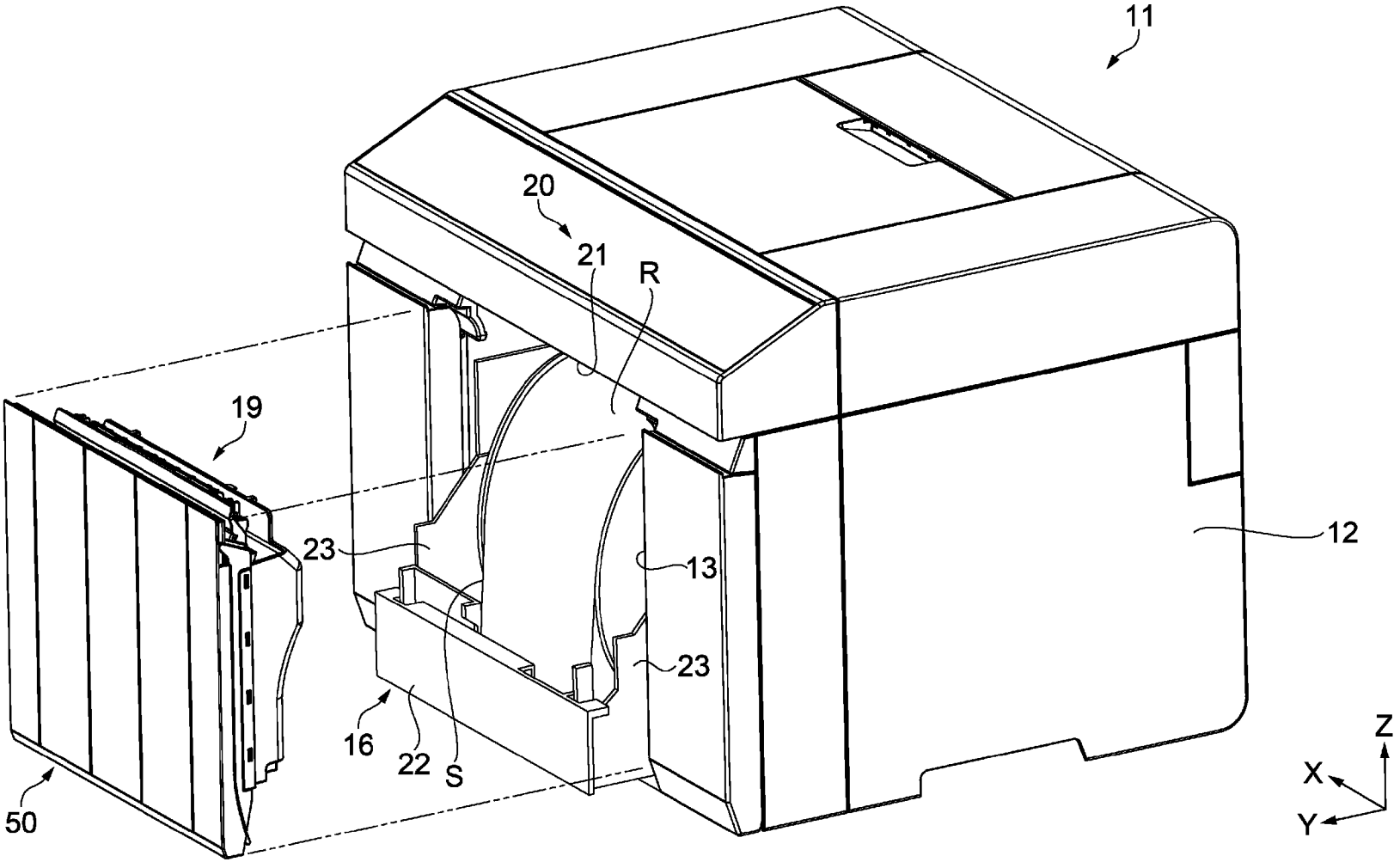
FIG. 3 is a perspective view illustrating configuration of the recording apparatus according to the first embodiment.

As shown in FIG. 3, an opening 13 is formed in the front-surface side of the housing 12 of the recording apparatus 11. In the housing 12, a medium-holding unit 16 is housed in a state in which it can be pulled out through the opening 13.

The medium-holding unit 16 is provided with a front-plate portion 22 constituting a part of the exterior of the recording apparatus 11 when the medium-holding unit 16 is housed in the housing 12, and a support wall 23 for rotatably supporting a roll body R of the elongated medium S wound up into a cylindrical shape.

The roll body R can be replaced or replenished by pulling the medium-holding unit 16 out through the opening 13.

The storage unit 19 of the present embodiment is detachably attached to the opening 13 of the housing 12.

Figure 4:
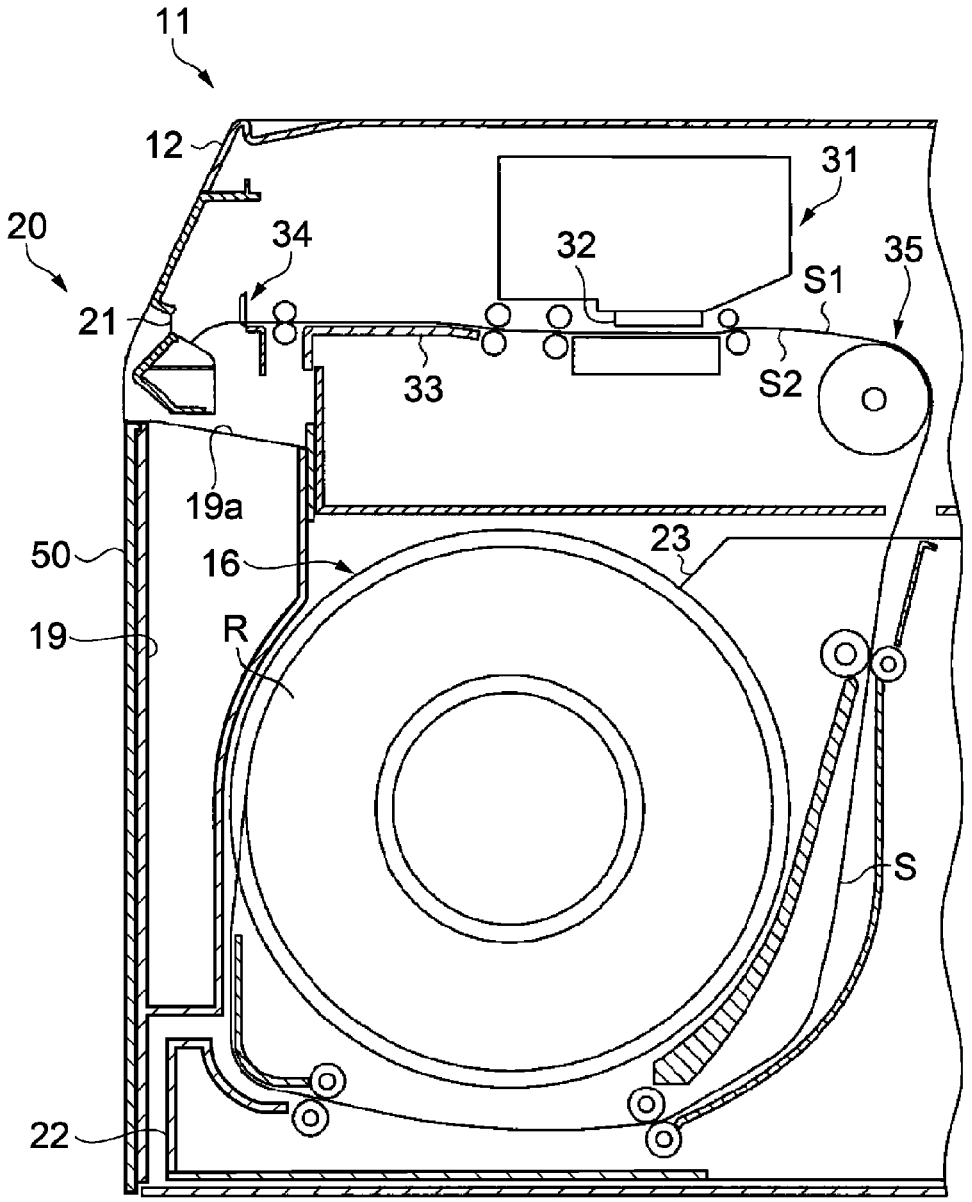
FIG. 4 is a cross-sectional view illustrating configuration of the recording apparatus according to the first embodiment.
Figure 4:
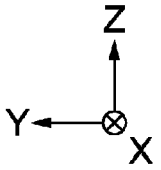

As shown in FIG. 4, in addition to the medium-holding unit 16, a recording unit 31, a transport unit 35, a cutting unit 34, a discharge unit 20, or the like are accommodated in the housing 12.

Specifically, the recording unit 31 for recording on medium S unwound from the roll body R is accommodated above the space for accommodating the medium-holding unit 16. The recording unit 31 includes a liquid-ejection head 32 that is configured to eject ink, which is an example of a recording material.

The medium S has a first surface S1, which is the surface on which ink is ejected, and a second surface S2, which is the surface to the rear of the first surface S1. The medium S is held in the medium-holding unit 16 in the state of the roll body R with the second surface S2 forming the inner-peripheral surface.

The recording apparatus 11 includes the transport unit 35 that transports the medium S along a transport direction from the medium-holding unit 16 toward a discharge port 21 provided in the front of the housing 12. The transport unit 35 includes a plurality of transport-roller pairs arranged along the transport direction.

The transport direction of the medium S in the present embodiment is a direction that first goes upward (the +Z-direction) from the medium-holding unit 16, and then goes toward the front side (the +Y-direction).

A heating unit 33 that dries the ink adhering to the medium S by heating the medium S is arranged downstream of the recording unit 31 in the transport direction of the medium S.

The cutting unit 34 for cutting the medium S is arranged downstream of the heating unit 33. The cutting unit 34 cuts the recorded portion of the elongated medium S for each unit length. Thus, the medium S becomes a cut sheet.

The storage unit 19 for storing the cutting waste of the medium S is arranged below the cutting unit 34. The storage unit 19 is a container having an inlet 19*a* that is opened upward. The cutting unit 34 of the present embodiment cuts off a margin portion or the like between the rear end of the medium S cut sheet that was cut previously and the front end of the medium S to be cut next. The cutting waste cut off from the medium S (the margin portion) falls downward and is stored in the storage unit 19 via the inlet 19*a*. In addition, by removing the storage unit 19 from the housing 12 as shown in FIG. 3, it is possible to discard the cutting waste contained in the storage unit 19.

The discharge unit 20 for discharging the cut sheet of the medium S cut by the cutting unit 34 is disposed downstream of the cutting unit 34 in the transport direction. The discharge unit 20 contains the discharge port 21, and the medium S is discharged from the discharge port 21. The discharge port 21 is on the front surface (the surface on the +Y-direction side) of the housing 12, and is disposed at a position above the opening 13 and the storage unit 19.

As shown in FIG. 2, the receiving unit 50 for receiving the discharged medium S is disposed downstream of the discharge port 21 in the transport direction. The receiving unit 50 is plate-shaped and has a receiving surface 50*a* for receiving the discharged medium S. The medium S is received by the receiving unit 50 with the second surface S2 and the receiving surface 50*a* facing each other. The second surface S2 is the opposite side of medium S from the recorded first surface S1.

Next, detailed configurations of the storage unit 19 and the receiving unit 50 will be described.

Figure 5:
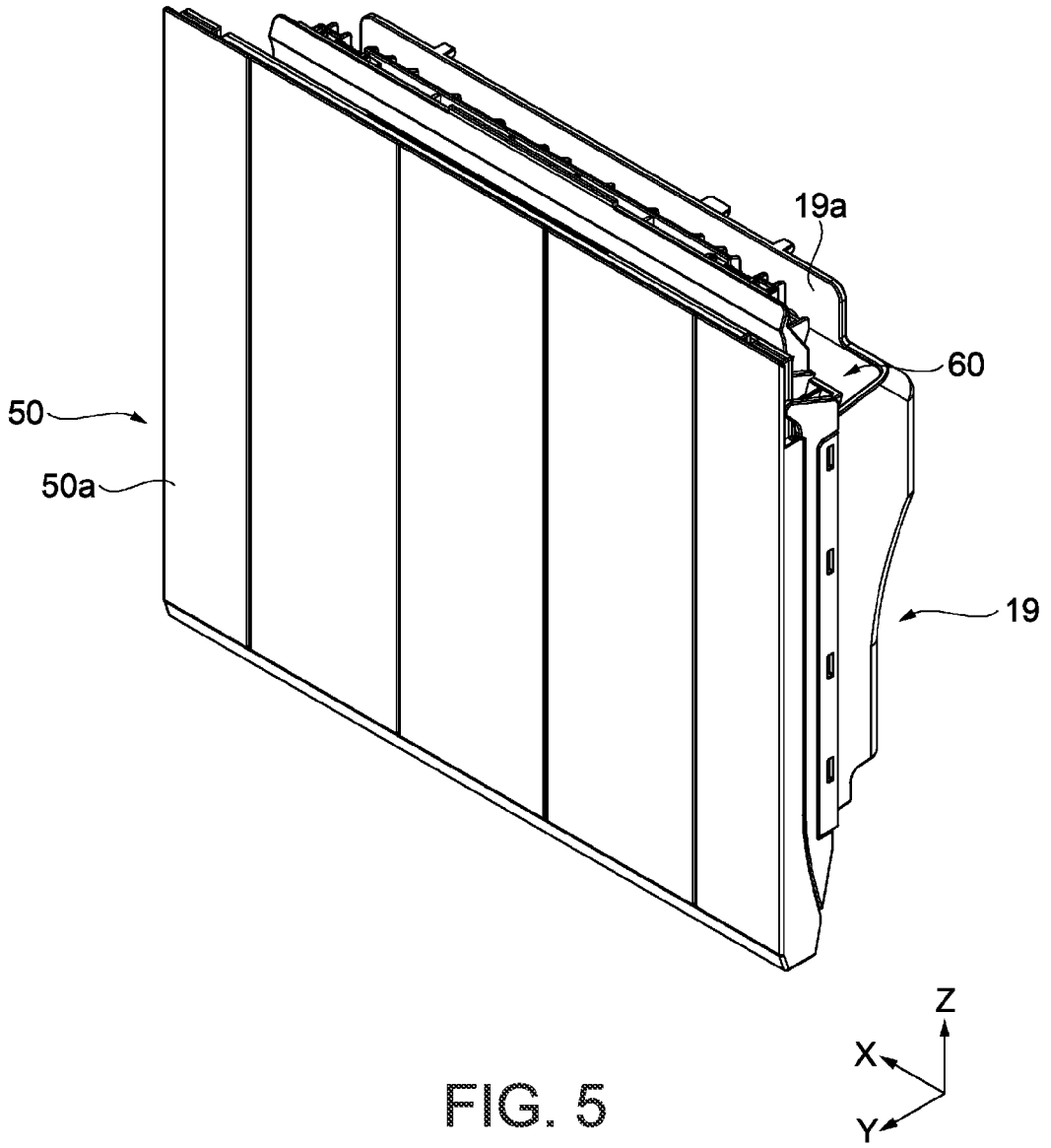
FIG. 5 is a perspective view illustrating configuration of a storage unit and a receiving unit according to the first embodiment.
Figure 6:
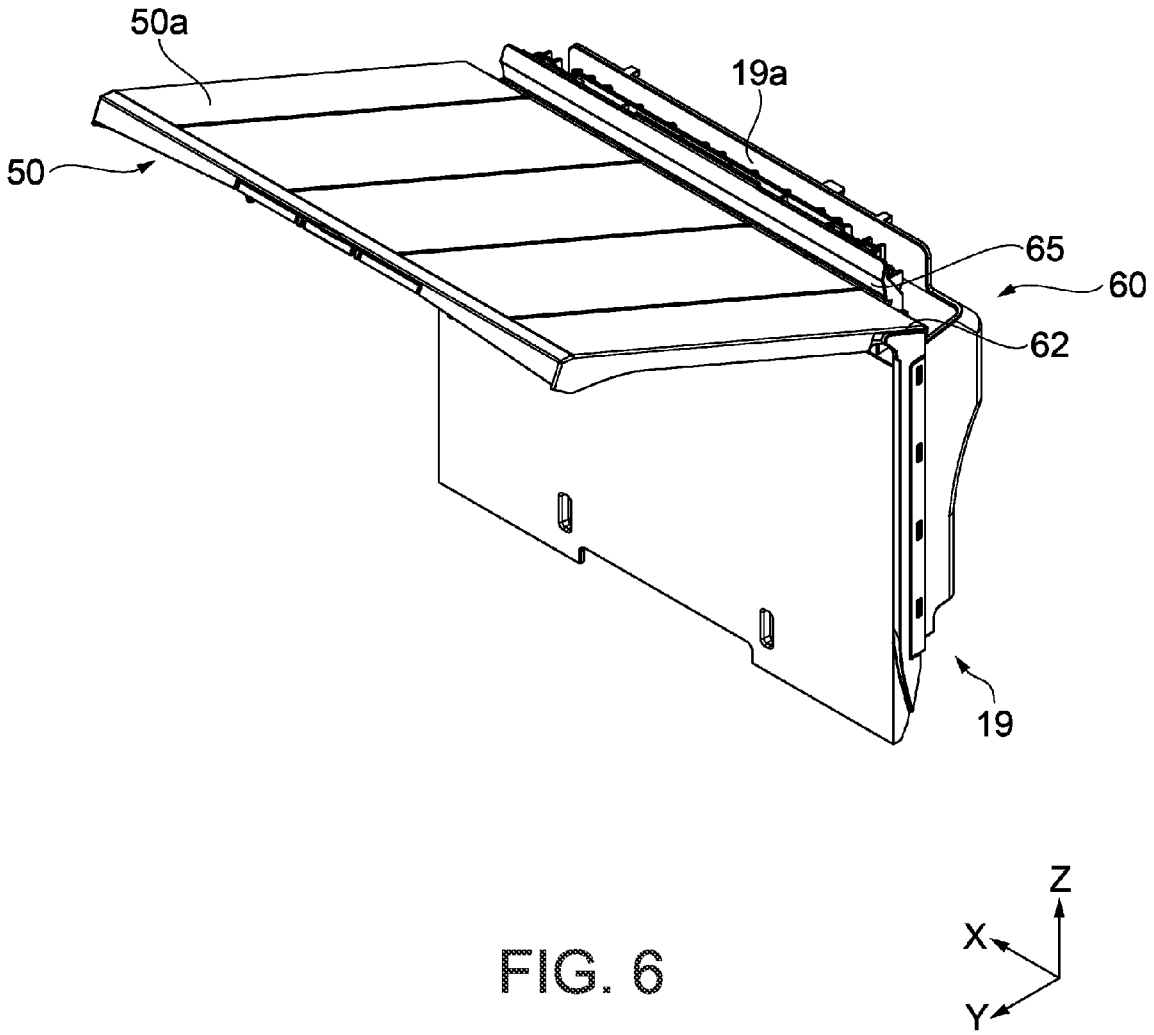
FIG. 6 is a perspective view illustrating configuration of the storage unit and the receiving unit according to the first embodiment.
Figure 7:
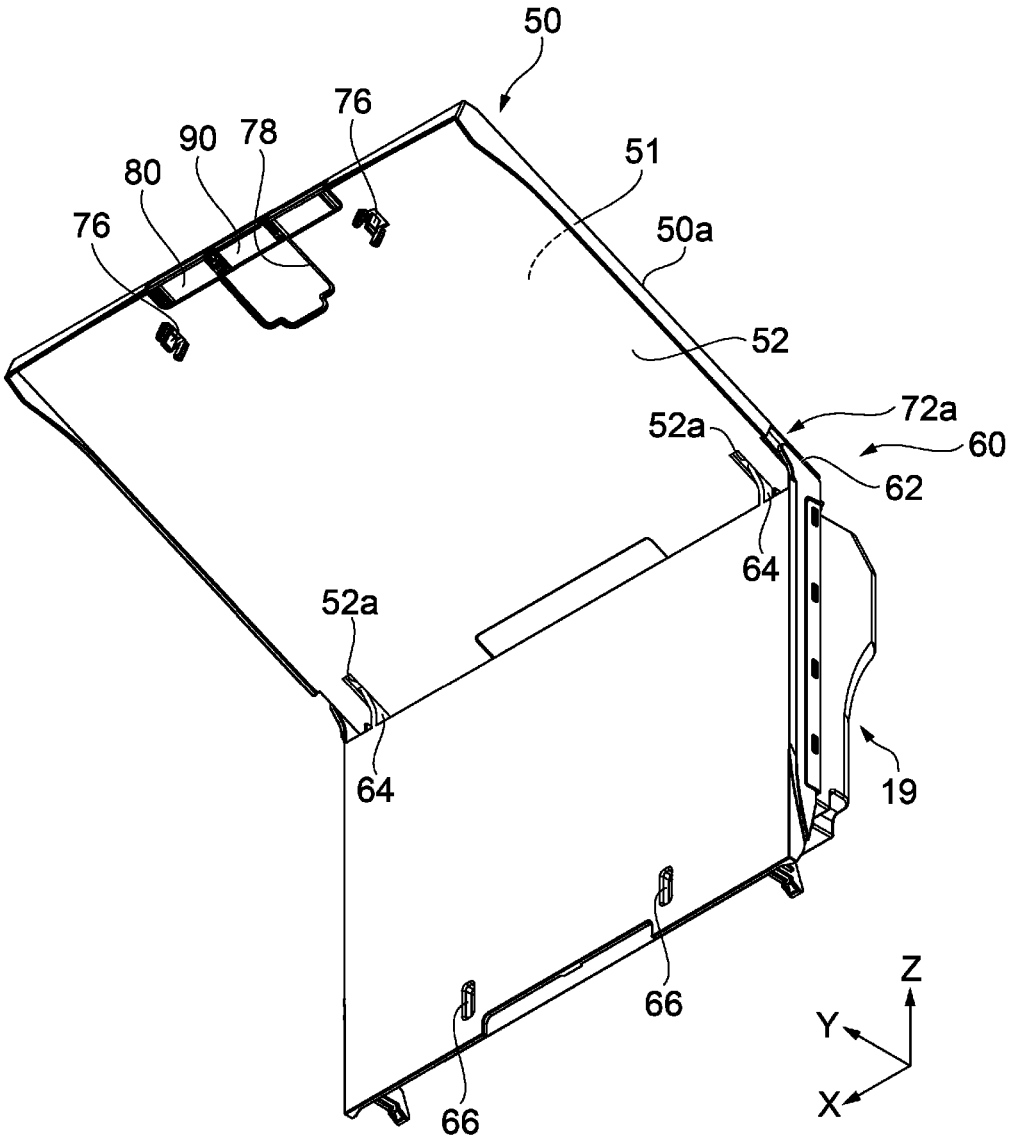
FIG. 7 is a perspective view illustrating configuration of the storage unit and the receiving unit according to the first embodiment.

As shown in FIGS. 5, 6, and 7, the recording apparatus 11 of the present embodiment has a configuration in which the storage unit 19 and the receiving unit 50 are integrated. As shown in FIG. 3, the integrated storage unit 19 and the receiving unit 50 are configured to be removable from the housing 12.

FIG. 5 shows the storage state of the receiving unit 50, and FIGS. 6 and 7 show the receiving state of the receiving unit 50. The receiving unit 50 and the storage unit 19 are displaceable by pivot portions 60 between the storage state and the receiving state.

Figure 8:
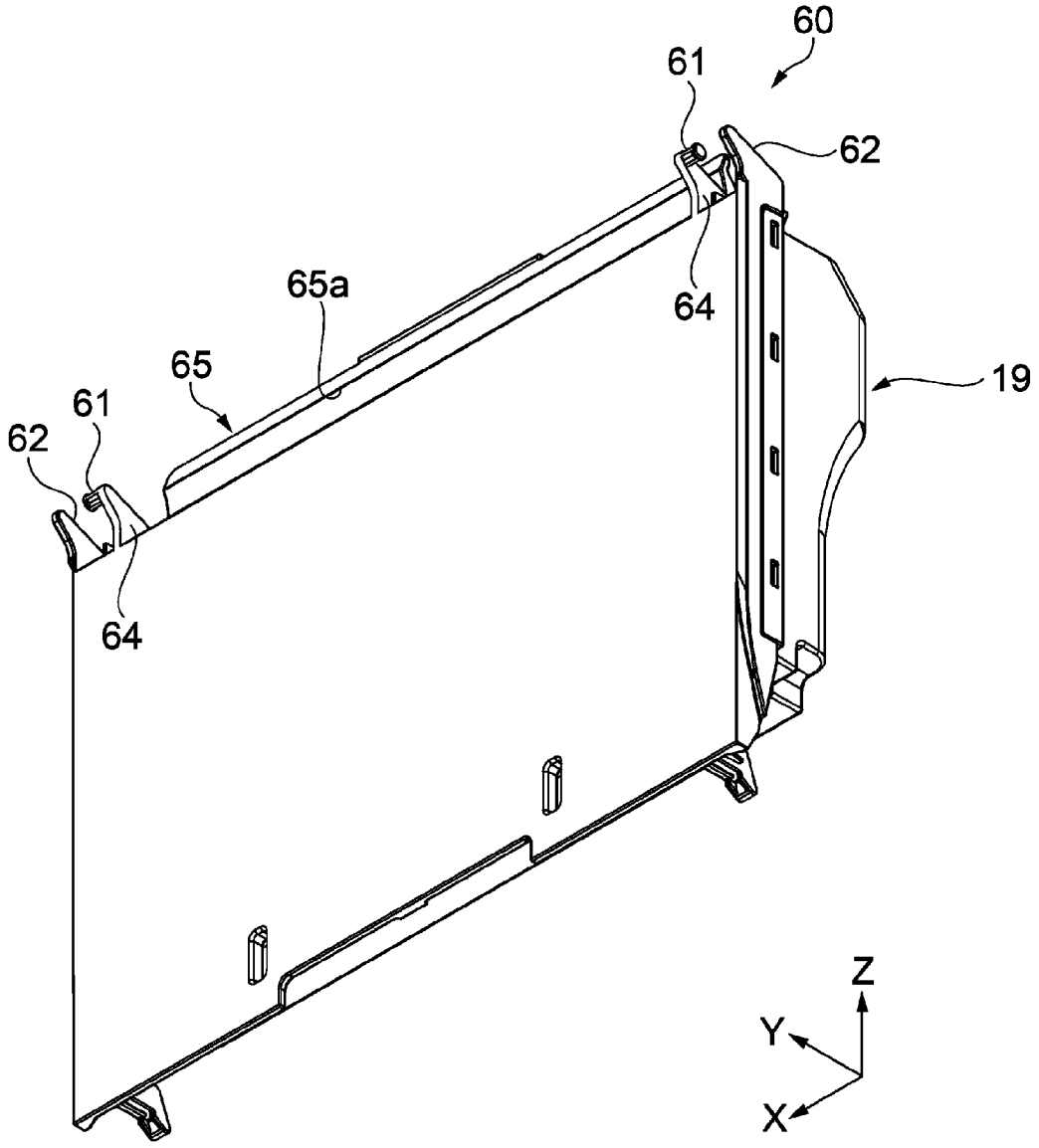
FIG. 8 is a perspective view illustrating configuration of the storage unit according to the first embodiment.
Figure 9:
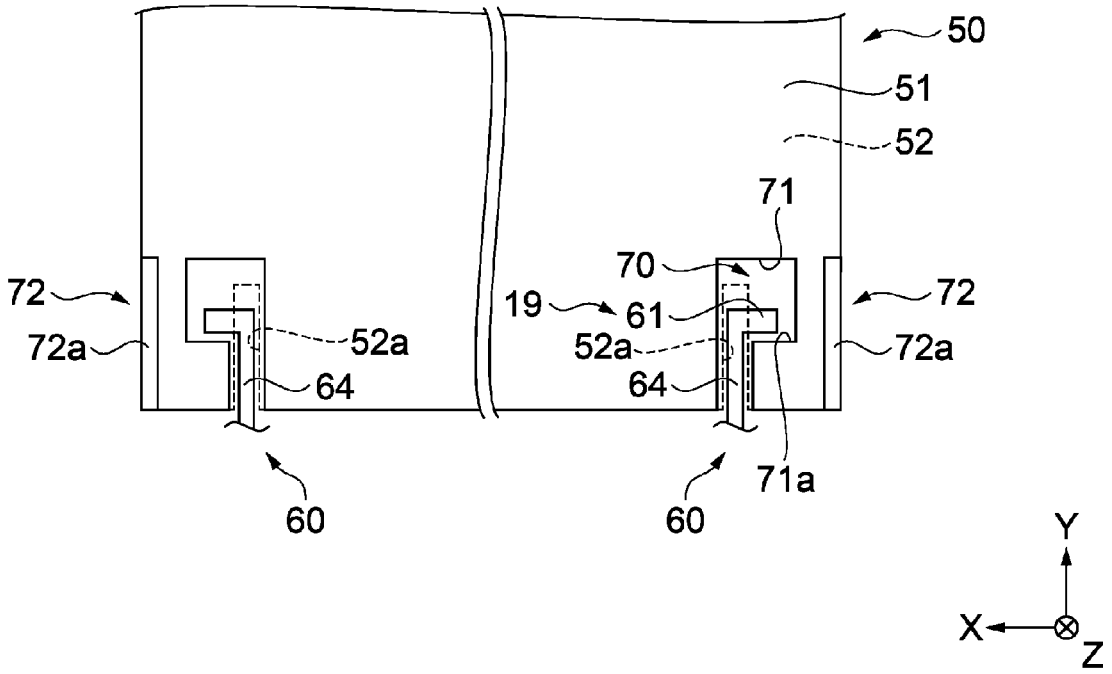
FIG. 9 is a partial plan view illustrating configuration of the storage unit and the receiving unit according to the first embodiment.

As shown in FIGS. 8 and 9, the pivot portions 60 configured to rotate the receiving unit 50 with respect to the storage unit 19 are provided on one end side of the discharge portion side of the receiving unit 50 (the discharge unit 20 side). The pivot portions 60 of the present embodiment are configured by shafts 61 and spaces 70.

In this embodiment, the shafts 61 are located in the storage unit 19 and the spaces 70 are located in the receiving unit 50.

As shown in FIG. 8, the shafts 61 are at +Y-direction end portions of the storage unit 19 and at an end portion in the +Z-direction. More specifically, plate-shaped protruding portions 64 protruding in the +Z-direction are formed at +Y-direction end portions of the storage unit 19, and the shafts 61 are formed at a tip portion of the protruding portions 64. The shafts 61 are arranged near either end of the storage unit 19 in the X-axis direction. The shafts 61 are formed along the X-axis.

As shown in FIG. 7, the receiving unit 50 is composed of a frame body formed by a first plate portion 51 and a second plate portion 52. The first plate portion 51 and the second plate portion 52 are approximately the same size.

The second plate portion 52 is disposed facing the opposite surface of the first plate portion 51 than the receiving surface 50*a*.

As shown in FIG. 9, recesses 71 are formed in the opposite surface of the first plate portion 51 than the receiving surface 50*a* at positions corresponding to the shafts 61. The recesses 71 have a rectangular shape in a plan view and are formed to be larger than the diameter of the shafts 61. Specifically, as shown in FIG. 9, the recesses 71 are formed larger than the shafts 61 in the direction along the Y-axis, the direction along the X-axis, and the direction along the Z-axis.

Then, in a state in which the shafts 61 are arranged in the recesses 71 of the first plate portion 51, the first plate portion 51 and the second plate portion 52 are combined to form the spaces 70 where the recesses 71 are provided. Also, the shafts 61 are disposed in the spaces 70. The first plate portion 51 and the second plate portion 52 are combined together so as to prevent the shafts 61 disposed in the spaces 70 from falling out of the spaces 70. Thus, the storage unit 19 and the receiving unit 50 are integrated.

As shown in FIGS. 7 and 9, relief grooves 52*a* for avoiding interference with the protruding portions 64 are provided at positions of the second plate portion 52 corresponding to the protruding portions 64. Thus, the receiving unit 50, which has the spaces 70, and the storage unit 19, which has the shafts 61, are configured to rotate relative to each other.

Also, since the spaces 70 are larger than the shafts 61, the receiving unit 50 can move in the Z-axis direction with respect to the storage unit 19 when the receiving unit 50 is in the storage state, and the receiving unit 50 can move in the substantially Y-axis direction with respect to the storage unit 19 when the receiving unit 50 is in the receiving state.

Further, as shown in FIG. 9, opposing surfaces 71*a* of the recesses 71 are formed in one direction intersecting with the extending direction (the direction along the X-axis) of the shafts 61 and abut the shafts 61 when the receiving unit 50 is in the storage state. Thus, movement of the receiving unit 50 in the −Z-direction with respect to the storage unit 19 is restricted when the receiving unit 50 is in the storage state. That is, in the storage state, the position of the receiving unit 50 with respect to the storage unit 19 is maintained. Therefore, when the recording apparatus 11 is not used, by placing the receiving unit 50 in the storage state, protrusion of the receiving unit 50 from the housing 12 in the +Y-direction can be suppressed, and the recording apparatus 11 can be made compact.

As shown in FIG. 7, recesses 66 are provided on the surface of the storage unit 19 on the +Y-direction side, that is, the surface facing the receiving unit 50. On the other hand, the surface of the second plate portion 52 of the receiving unit 50 facing the storage unit 19 is provided with protruding portions 76 that can fit into the recesses 66 of the storage unit 19. When the receiving unit 50 is in the storage state, the protruding portions 76 fit into the recesses 66. As a result, for example, when the recording apparatus 11 is moved while the receiving unit 50 is in the storage state, rattling of the receiving unit 50 against the housing 12 is suppressed.

As shown in FIGS. 2 and 6, when the receiving unit 50 is in the receiving state, an end portion of the receiving unit 50 in the +Y-direction (another end) is disposed at a position higher than the position of the discharge port 21 of the discharge unit 20. In the present embodiment, the receiving surface 50*a* of the receiving unit 50 is inclined upward from the discharge port 21 side toward the +Y-direction. Thus, the medium S discharged from the discharge unit 20 can be surely received.

In particular, as shown in FIGS. 6 and 8, a support surface 62 is provided at either end of the storage unit 19 in the direction along the X-axis, to support the receiving unit 50 when the receiving unit 50 is in the receiving state. The support surfaces 62 are inclined surfaces inclining upward from the −Y-direction toward the +Y-direction when viewed in the +X-direction. The support surfaces 62 of the present embodiment are inclined upward by about 20° with respect to the horizontal direction.

On the other hand, as shown in FIG. 9, grooves 72 are formed in the opposite surface of the receiving unit 50 than the receiving surface 50*a*, one at both ends in the direction along the X-axis, at positions corresponding to the support surfaces 62 in the receiving state. The grooves 72 are provided with an abutment surface 72*a* configured to abut the corresponding support surface 62.

As shown in FIG. 8, the upper end of the storage unit 19 is provided with a protrusion 65 having an abutment surface 65*a* abutting the receiving surface 50*a* in the receiving state. The abutment surface 65*a* extends in a direction along the X-axis.

Next, a method of displacing the receiving unit 50 from the storage state to the receiving state will be described.

First, in the storage state, the lower end portion of the receiving unit 50 is pulled out in the +Y-direction with respect to the storage unit 19 (the housing 12). As a result, the protruding portions 76 of the receiving unit 50 detach from the recesses 66 of the storage unit 19, and the receiving unit 50 becomes pivotable around the shafts 61 of the storage unit 19. Then, the receiving unit 50 is rotationally moved upwardly with respect to the storage unit 19. When the abutment surfaces 72*a* of the receiving unit 50 and the support surfaces 62 of the storage unit 19 abut against each other, the rotational movement of the receiving unit 50 with respect to the storage unit 19 is restricted. With the abutment surfaces 72*a* and the support surfaces 62 in abutment, the receiving unit 50 is then pushed in the direction of the discharge port 21 (the −Y-direction). Because of the spaces 70, the receiving unit 50 can move in the −Y-direction relative to the storage unit 19. By moving the receiving unit 50 in the −Y-direction, a portion of the receiving surface 50*a* on the discharge port 21 side abuts the abutment surface 65*a*. Thus, the receiving unit 50 is held by the abutment surface 65*a* and the support surfaces 62, and the receiving surface 50*a* of the receiving unit 50 is held in a receiving state inclined upward in the +Y-direction from the discharge port 21 side. In the present embodiment, the angle of the receiving surface 50*a* with respect to the horizontal plane is about 20°.

Next, a method of displacing the receiving unit 50 from the receiving state to the storage state will be described.

First, while in the receiving state, the receiving unit 50 is pulled out in the +Y-direction with respect to the storage unit 19 (the housing 12). Thus, the receiving unit 50 separates from the abutment surface 65*a* and the support surfaces 62, and becomes pivotable about the shafts 61 of the storage unit 19. Then, the receiving unit 50 is rotationally moved downwardly with respect to the storage unit 19. When the receiving unit 50 rotates downward, the shafts 61 abut against the opposing surfaces 71*a*, and the receiving unit 50 is supported by the storage unit 19. Then, with the lower end portion of the receiving unit 50 facing downward, the lower end portion of the receiving unit 50 is pushed in the −Y-direction toward the storage unit 19 (the housing 12). As a result, the protruding portions 76 of the receiving unit 50 fit into the recesses 66 of the storage unit 19, and the storage state is held.

Next, an extension 80 of the receiving unit 50 will be described.

Figure 10:
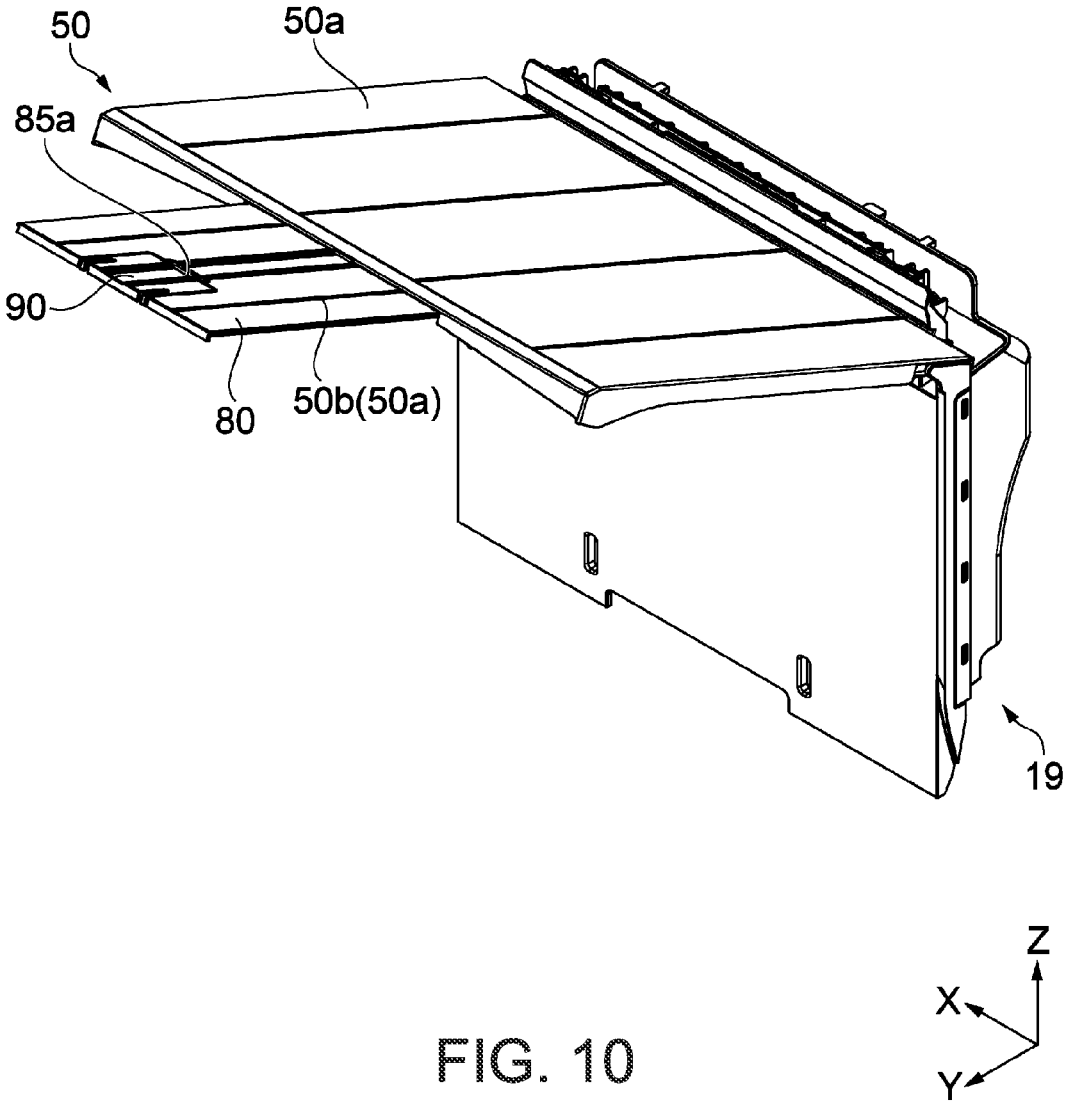
FIG. 10 is a perspective view illustrating configuration of an extension according to the first embodiment.

As shown in FIGS. 2 and 10, the receiving unit 50 has the extension 80 that is configured to extend the receiving surface 50*a* in the transport direction (the direction in which the medium S is transported from the discharge port 21 substantially toward the +Y-direction).

The extension 80 of the present embodiment has a plate shape and is smaller than the first plate portion 51 or the second plate portion 52. The extension 80 is housed in a withdrawable manner, between the first plate portion 51 and the second plate portion 52 in the direction along the discharge direction (the +Y-direction in FIG. 10).

As shown in FIG. 7, a cutout portion 78 is formed in the second plate portion 52 and in the receiving state a portion of the extension 80 is exposed by the cutout portion 78. Thus, the extension 80 can be easily pulled out by hooking fingers onto the exposed part of the extension 80. The extension 80 has a stopper, and the extension 80 is held by a predetermined pull-out amount. By including the extension 80, the receiving surface 50*a* of the receiving unit 50 (including a receiving surface 50*b*) capable of receiving the medium S can be elongated. By this a longer medium S can be received. Note that the extension 80 may be configured according to the length of the medium S discharged from the discharge port 21. For example, the length of the extension 80 in the transport direction may be increased. In addition, the pull-out structure may be configured in three or more stages. Further, the extension 80 may have an unfolding structure instead of a pull-out structure.

Next, a regulation part 90 of the receiving unit 50 will be described.

As shown in FIGS. 2 and 10, the receiving unit 50 is provided with the regulation part 90 at the downstream end of the receiving unit 50 in the transport direction (the direction in which the medium S is transported from the discharge port 21 toward the substantially +Y-direction). The regulation part 90 is for restricting the movement in the transport direction of the medium S to be received.

The regulation part 90 pivots and switches between a regulating state (FIG. 2) in which it protrudes upward from the receiving surface 50*a* (50*b*) and a retracted state (FIG. 10) in which it is flush with the receiving surface 50*a* (50*b*).

It should be noted that the regulation part 90 of the present embodiment is provided at the downstream end of the extension 80.

As shown in FIGS. 2 and 10, the regulation part 90 has a plate shape. The regulation part 90 is smaller than the extension 80. A recess 85 is provided in a part of the receiving surface 50*b* of the extension 80, and the regulation part 90 is configured to be stored in the recess 85. The thickness dimension of the regulation part 90 is equivalent to the depth dimension of the recess 85. Therefore, in the retracted state, the receiving surface 50*b* and the regulation part 90 form a continuous flat surface.

The downstream end part of the regulation part 90 is provided with a shaft that is rotatable with respect to the extension 80, and a stopper for restricting the rotated position of the regulation part 90 at a predetermined position.

In the case of moving the regulation part 90 from the retracted state to the regulating state, fingers are inserted into a cutout portion 85*a* provided in the recess 85 to rotationally move the regulation part 90 around the shaft. The rotating regulation part 90 is held in place by the stopper. In this regulating state, the angle between the receiving surface 50*b* and the regulation part 90 is 100° to 130°.

The regulation part 90 of the present embodiment is housed together with the extension 80 between the first plate portion 51 and the second plate portion 52.

By the regulation part 90, medium S falling off the receiving unit 50 can be suppressed. In addition, in the storage state of the receiving unit 50, there is no protrusion from the housing 12 in the +Y-direction, and compactness is enhanced.

In the present embodiment, curled up medium S may be discharged from the discharge port 21. In this case, the discharged medium S is received in a state of being curled in a convex shape protruding upward with respect to the receiving surface 50*a* and 50*b*. In this state, when the next medium S is discharged, the downstream end of the medium S contacts the previously received medium S, and the previously received medium S is pushed downstream. However, the downstream end of the previously received medium S abuts against the regulation part 90, and downstream movement of the medium S is restricted. The medium S discharged next is then supported on the upper surface of the medium S discharged previously. That is, the medium S is received by the receiving unit 50 in the order of discharge of the medium S.

Here, a front portion 19*b* of the storage unit 19 on the transport direction side (the +Y-direction side) and the receiving unit 50 are formed of light-transmissive members. For example, the storage unit 19 and the receiving unit 50 are made of transparent plastic material.

As a result, the inside of the storage unit 19 is viewable regardless of whether the receiving unit 50 is in the storage state, as shown in FIG. 1, or the receiving unit 50 is in the receiving state, as shown in FIG. 2, and the storage state of the stored cutting waste in the storage unit 19 can be easily confirmed.

Note that the front portion 19*b* of the storage unit 19 on the transport direction side may be formed of a light-transmissive member, and an opening may be provided in the receiving unit 50. For example, a through-hole such as a slit may be provided at the center of the receiving unit 50. Even in this case, the same effect as described above can be obtained.

As described above, according to the present embodiment, the storage unit 19 and the receiving unit 50 are integrally configured. Therefore, as compared with a configuration in which the storage unit 19 and the receiving unit 50 are separate bodies, a space for placing the receiving unit 50 is not necessary. Also, losing the receiving unit 50 can be prevented.

In addition, when the cutting waste contained in the storage unit 19 is to be disposed, for example, when the storage unit 19 and the receiving unit 50 are configured as separate bodies, it is necessary to first remove the receiving unit 50 from the housing 12 and then remove the storage unit 19 from the housing 12. However, according to the present embodiment, since the storage unit 19 and the receiving unit 50 are configured to be detached from the housing 12 together (FIG. 3), cutting waste can be easily disposed of and operability can be improved.

2. Second Embodiment

Next, a second embodiment will be described.

The same components as those in the first embodiment are denoted by the same reference numerals, and redundant description thereof will be omitted. In the first embodiment, the receiving unit 50 in the receiving state is inclined upward, but the present disclosure is not limited thereto.

Figure 11:
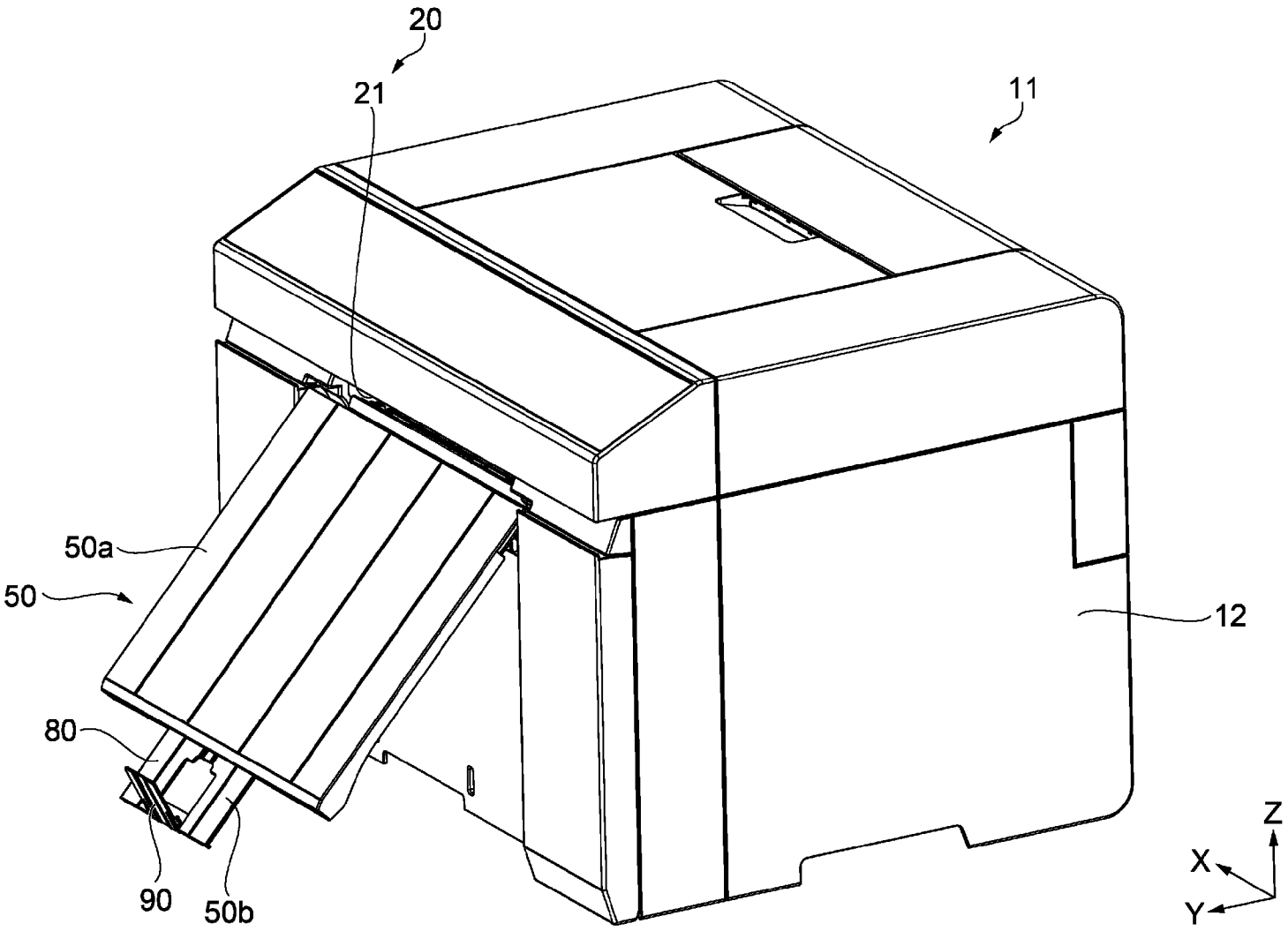
FIG. 11 is a perspective view illustrating the form of a receiving unit according to a second embodiment.

In the present embodiment, as shown in FIG. 11, when the receiving unit 50 is in the receiving state, the +Y-direction end portion (the other end) of the receiving unit 50 is disposed at a position lower than the discharge port 21 position of the discharge unit 20. In the present embodiment, the receiving surface 50*a* of the receiving unit 50 inclines downward from the discharge port 21 side toward the +Y-direction. In this case, in order to maintain the position of the receiving unit 50 in the receiving state, the angle of the support surfaces 62 of the storage unit 19 in contact with the receiving unit 50 or the angle of the abutment surface 65*a* of the protrusion 65 may be changed.

In this manner, the medium S discharged from the discharge port 21 can be received.

3. Third Embodiment

Next, a third embodiment will be described.

The same components as those in the first embodiment are denoted by the same reference numerals, and redundant description thereof will be omitted.

Figure 12:
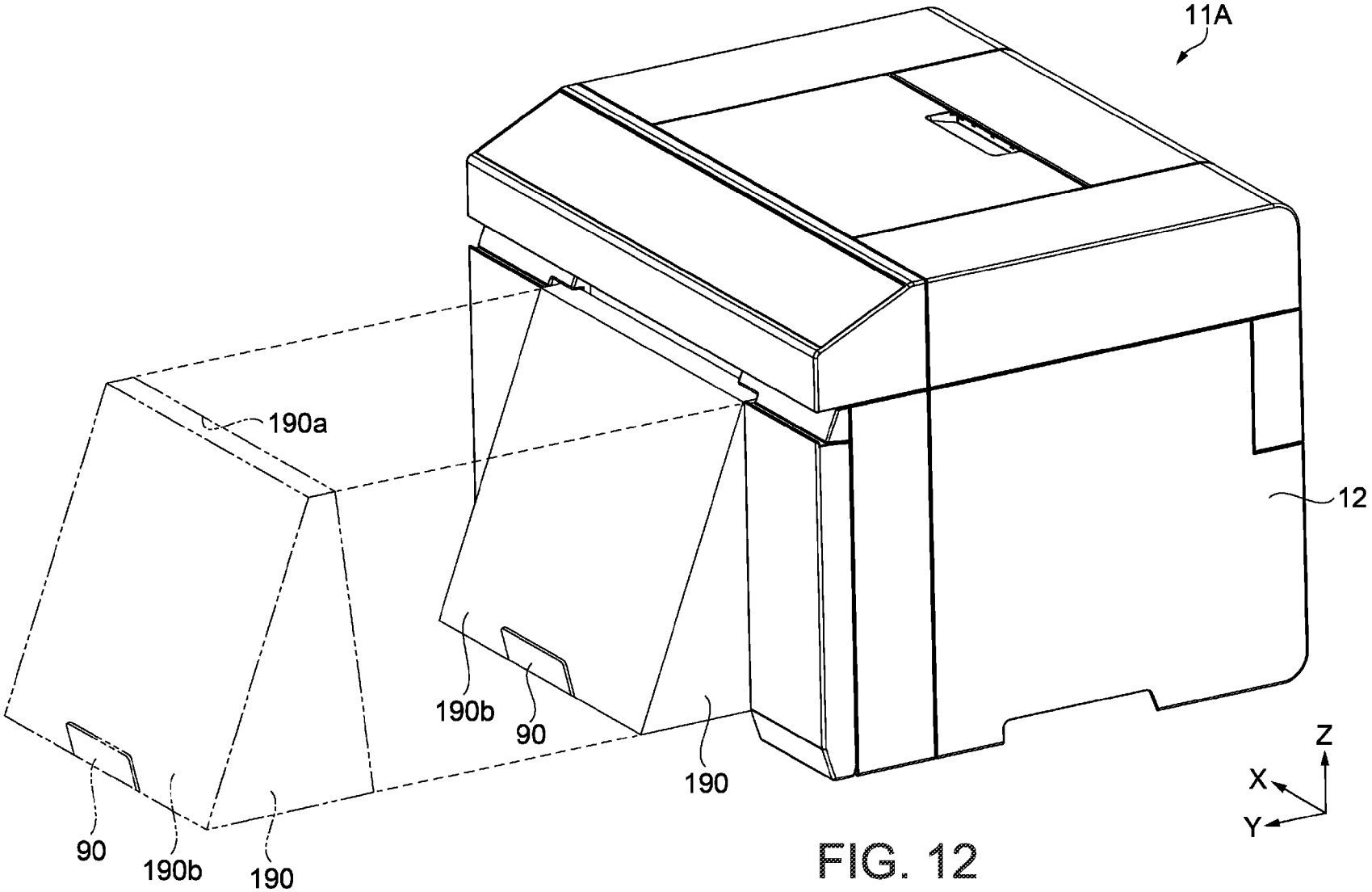
FIG. 12 is a perspective view illustrating configuration of a recording apparatus according to a third embodiment.

As shown in FIG. 12, a storage unit 190 of a recording apparatus 11A of the present embodiment is formed with an inclined surface in which the front surface 190*b* on the transport direction side (the +Y-direction side) of the storage unit 190 protrudes forward (+Y-direction) from above to below. The inclined surface serves as a receiving surface 190*b* that receives the medium S.

The storage unit 190 is a square frustum shaped container and has an inlet 190*a* on the upper side. The receiving surface 190*b* is inclined from the discharge port 21 side to the lower end portion toward the +Y-direction. That is, the storage unit 190 and the receiving unit are integrally formed.

According to the present embodiment, in addition to the above-described effects, the volume in the storage unit 190 capable of accommodating cutting waste can be further increased.

What is claimed is:

1. A recording apparatus comprising:

a housing that houses:

a transport unit that transports a medium in a transport direction, a recording unit that performs recording on the medium transported by the transport unit, a cutting unit that is disposed downstream of the recording unit in the transport direction and that cuts the medium, and a discharge unit that is disposed downstream of the cutting unit in the transport direction and that discharges the cut medium;

a storage unit that is disposed below the cutting unit and that is configured to store cutting waste of the medium;

a receiving unit that is disposed downstream of the discharge unit in the transport direction and that has a receiving surface configured to receive the medium discharged from the discharge unit; and a pivot portion on one end side of a discharge unit side of the receiving unit, the pivot portion being configured to pivot the receiving unit with respect to the storage unit, the receiving unit being displaced between a storage state, in which another end of the receiving unit, which is on an opposite side from the discharge unit, retreats toward the housing side, and a receiving state, in which the receiving unit pivots with respect to the storage unit to advance from the housing, wherein the storage unit and the receiving unit are integrated, and the integrated storage unit and receiving unit are configured to be detachable from the housing.

2. The recording apparatus according to claim 1, wherein the receiving unit and a front portion of the storage unit in the transport direction are formed of a light-transmissive member.

3. The recording apparatus according to claim 1, wherein a front portion in the transport direction of the storage unit is formed of a light-transmissive member.

4. The recording apparatus according to claim 1, wherein in the receiving state, the other end of the receiving unit is disposed at a position higher than a position of the discharge unit.

5. The recording apparatus according to claim 1, wherein in the receiving state, the other end of the receiving unit is disposed at a position lower than a position of the discharge unit.

6. The recording apparatus according to claim 1, wherein the receiving unit has an extension configured to extend the receiving surface in the transport direction.

7. The recording apparatus according to claim 1, further comprising:

a regulation part that regulates movement in the transport direction of a received medium, the regulation part being provided on the receiving unit at an end portion thereof downstream in the transport direction, wherein the regulation part is pivoted and switched between a regulating state, in which the regulation part protrudes upward from the receiving surface, and a retracted state, in which the regulation part is flush with the receiving surface.

* * * * *